US009752457B2

(12) United States Patent
Hiller et al.

(10) Patent No.: US 9,752,457 B2
(45) Date of Patent: Sep. 5, 2017

(54) TURBINE HOUSING FOR A TURBOCHARGER

(71) Applicant: CONTINENTAL AUTOMOTIVE GMBH, Hannover (DE)

(72) Inventors: Marc Hiller, Morschheim (DE); Christian Uhlig, Worms (DE); Holger Faeth, Fussgoenheim (DE)

(73) Assignee: Continental Automotive GmbH, Hannover (DE)

( * ) Notice: Subject to any disclaimer, the term of this patent is extended or adjusted under 35 U.S.C. 154(b) by 344 days.

(21) Appl. No.: 14/406,383

(22) PCT Filed: Jun. 5, 2013

(86) PCT No.: PCT/EP2013/061626
§ 371 (c)(1),
(2) Date: Dec. 8, 2014

(87) PCT Pub. No.: WO2013/182619
PCT Pub. Date: Dec. 12, 2013

(65) Prior Publication Data

US 2015/0184542 A1 Jul. 2, 2015

(30) Foreign Application Priority Data

Jun. 6, 2012 (DE) ..... 10 2012 209 562

(51) Int. Cl.
*F01D 25/24* (2006.01)
*F01D 9/02* (2006.01)
(Continued)

(52) U.S. Cl.
CPC ..... *F01D 25/24* (2013.01); *F01D 9/026* (2013.01); *F01D 17/105* (2013.01); *F01D 25/30* (2013.01);
(Continued)

(58) Field of Classification Search
CPC ..... F01D 9/026; F01D 25/24; F01D 25/243; F01D 17/105; F02B 37/18; F02B 37/183; F02B 37/186; F02B 39/00
See application file for complete search history.

(56) References Cited

U.S. PATENT DOCUMENTS 6,553,762 B2 * 4/2003 Loffler ..... F01D 9/026 415/203
8,628,296 B2 * 1/2014 Grussmann ..... F01D 25/243 415/204
(Continued)

FOREIGN PATENT DOCUMENTS

CN 201246213 Y 5/2009
CN 102221016 A 10/2011
(Continued)

*Primary Examiner* — Ninh H Nguyen
(74) *Attorney, Agent, or Firm* — Laurence A. Greenberg; Werner H. Stemer; Ralph E. Locher

(57) ABSTRACT

A turbine housing for a turbocharger has a plurality of interconnected housing parts. A central, one-piece contoured component that is constructed as a cast component or a forged component is provided on that side of a spiral channel which faces away from a bearing housing attachment flange in the turbine housing. The contoured component has a wall region of the spiral channel, a boundary wall of an exhaust gas inlet gap and a sealing contour region. The contoured component is connected to its adjacent housing parts, which are at least partly constructed as sheet metal molded parts, so as to form the turbine housing.

14 Claims, 3 Drawing Sheets

(51) Int. Cl.

| | |
|---|---|
| ***F01D 25/30*** | (2006.01) |
| ***F01D 17/10*** | (2006.01) |
| *F02B 39/00* | (2006.01) |

(52) U.S. Cl.

CPC ..... *F02B 39/00* (2013.01); *F05D 2220/40* (2013.01); *F05D 2230/21* (2013.01); *F05D 2230/232* (2013.01); *F05D 2230/25* (2013.01); *F05D 2230/54* (2013.01); *F05D 2300/111* (2013.01)

(56) References Cited

U.S. PATENT DOCUMENTS

| | | | | |
|---|---|---|---|---|
| 8,726,655 | B2 * | 5/2014 | Smatloch ..... | F01D 9/026 29/889.2 |
| 8,882,444 | B2 | 11/2014 | Williams et al. | |
| 9,021,802 | B2 | 5/2015 | Petitjean et al. | |
| 9,255,485 | B2 * | 2/2016 | Watanabe ..... | F01D 9/026 |
| 2010/0074744 | A1 * | 3/2010 | Phillips, Jr. ..... | F01D 9/026 415/208.1 |
| 2012/0047887 | A1 | 3/2012 | Petitjean et al. | |
| 2012/0275914 | A1 | 11/2012 | Yokoyama et al. | |

FOREIGN PATENT DOCUMENTS

| | | | |
|---|---|---|---|
| CN | 102400720 | A | 4/2012 |
| DE | 10022052 | A1 | 3/2001 |
| DE | 102011009634 | A1 | 8/2012 |
| EP | 2423446 | A2 | 2/2012 |
| EP | 2441924 | A1 | 4/2012 |
| WO | 2011045521 | A1 | 4/2011 |
| WO | 2011104596 | A2 | 9/2011 |

* cited by examiner

TURBINE HOUSING FOR A TURBOCHARGER

BACKGROUND OF THE INVENTION

Field of the Invention

The invention relates to a turbine housing for an exhaust-gas turbocharger.

Exhaust-gas turbochargers are increasingly used for increasing the power of motor vehicle internal combustion engines. This is ever more commonly done with the aim of reducing the structural size and weight of the internal combustion engine maintaining the same power or even increasing power, while at the same time reducing fuel consumption and thus $CO_2$ emissions with regard to ever more stringent legal regulations in this regard. The operating principle consists in utilizing the energy contained in the exhaust-gas stream to increase the pressure in the intake tract of the internal combustion engine and thus realize improved charging of the combustion chamber with atmospheric oxygen, and thus make it possible for more fuel, gasoline or diesel, to be converted per combustion process, that is to say increase the power of the internal combustion engine.

A conventional exhaust-gas turbocharger as illustrated in FIG. 1 has, for this purpose, an exhaust-gas turbine 101 which is arranged in the exhaust tract of the internal combustion engine and which has a turbine wheel 11, which is arranged in a turbine housing 1 and driven by the exhaust-gas stream, and a fresh-air compressor 102, which is arranged in the intake tract and which has a compressor wheel 16 which builds up the pressure and which is arranged in a compressor housing 15. The turbine wheel 11 and compressor wheel 16 are fastened rotationally conjointly to the opposite ends of a rotor shaft 17 and thus form the rotary unit, referred to here as turbo rotor, of the exhaust-gas turbocharger. The rotor shaft 17 is rotatably mounted in a bearing unit, arranged between exhaust-gas turbine 101 and fresh-air compressor 102, in the bearing housing 100. Thus, by means of the exhaust-gas mass stream AM (indicated by arrows), the turbine wheel 11, and via the rotor shaft 17 in turn the compressor wheel 16, are driven, and the exhaust-gas energy is thus utilized for building up pressure in the intake tract, where the fresh-air mass stream FM (likewise indicated by arrows) is brought to an elevated pressure.

The hot exhaust-gas mass stream AM is conducted through the turbine housing 1 to the turbine wheel 11. The turbine housing 1 and the turbine wheel 11 are thus, during operation, in direct contact with the hot exhaust-gas mass stream AM and are thus subject to very great temperature fluctuations, with peak temperatures of up to over 1000° C. being reached. At the same time, the turbo rotor rotates at very high rotational speeds of up to 300,000 rpm, whereby in particular the turbine wheel 11 and the turbine housing 1 are subjected to very high mechanical and thermal loads.

In the case of exhaust-gas turbochargers of conventional construction, as illustrated in FIG. 1, the turbine housing 1 is connected by means of a bearing housing attachment flange 4 to the centrally arranged bearing housing 100 of the exhaust-gas turbocharger. Furthermore, the turbine housing 1 has an exhaust-gas inlet pipe 2*b* which forms an exhaust-gas inlet duct 2 and which has an exhaust-gas inlet flange 2*a* for attachment of the exhaust-gas turbocharger to the exhaust manifold (not illustrated) of an internal combustion engine. The hot exhaust gas enters the turbine housing 1 through the exhaust-gas inlet duct 2, as indicated by means of the exhaust-gas mass stream AM illustrated by arrows. Furthermore, the turbine housing 1 has a spiral duct 5 which adjoins the exhaust-gas inlet duct 2 and which runs in tapering fashion around, and is open toward, an exhaust-gas inlet gap 5*a* arranged concentrically around the turbine wheel, such that the exhaust-gas mass stream AM is conducted through the spiral duct 5 to the turbine wheel 11 in an at least partially radial/tangential direction through the exhaust-gas inlet gap 5*a*. The exhaust-gas stream AM is diverted by the turbine wheel 11 in an axial direction into an exhaust-gas outlet connector 7, through which the exhaust-gas mass stream AM is discharged into the exhaust-gas outlet pipe 3*b* and onward into an adjoining exhaust system connected to an exhaust-gas outlet flange 3*a*. At the transition between the exhaust-gas inlet gap 5*a* and the exhaust-gas outlet connector 7, the internal contour of the turbine housing is matched to the external contour of the blade arrangement 10 of the turbine wheel 11. To ensure that as great as possible a fraction of the exhaust-gas mass stream flows through the blade arrangement 10 of the turbine wheel 11 and thus drives the turbine wheel 11, the contour gap 12 between the inner contour of the turbine housing and the outer contour of the blade arrangement 10 of the turbine wheel 11 must be kept as small as possible. The contour gap has a significant influence on the flow characteristics and thermodynamic characteristics of the exhaust-gas turbine. Said region of the internal contour of the turbine housing thus, in effect, seals off the blade arrangement 10 of the turbine wheel over the circumference, whereby said region of the internal contour of the turbine housing is hereinafter referred to as sealing contour region 9 or, for short, as sealing contour 9.

Owing to the above-mentioned contour gap 12, which should be designed to be as small as possible, the dimensional and positional stability of the sealing contour 9 is of great significance because contact between the turbine wheel 11, which rotates at high speed during operation, and the sealing contour 9 would inevitably lead to destruction of the exhaust-gas turbine.

Furthermore, exhaust-gas turbines of modern design have a so-called wastegate device 13 which permits improved regulation of the turbine power under varying operating conditions. A wastegate device of said type is composed of a connecting duct, the wastegate duct 8, between the exhaust-gas inlet duct 2 or the spiral duct 5 and the exhaust-gas outlet duct 3, and of an associated valve flap 14 by means of which said wastegate duct 8 can be closed or opened as required. To keep possible losses as small as possible, it must be ensured here, too, that the valve flap 14, when required, closes with the greatest possible sealing action against a valve seat 8*a* on or in the wastegate duct 8. To be able to meet the high requirements with regard to form and positional accuracy while simultaneously withstanding high thermal and mechanical loads, and also owing to the complex internal and external geometries of the turbine housing, conventional turbine housings are therefore designed and produced as very massive cast parts. Aside from the high weight and high thermal capacity, this embodiment of the turbine housing also results in high material and production costs, which is disadvantageous with regard to the use, operation and costs of exhaust-gas turbochargers of said type.

There are thus demands for the turbine housing to be constructed from relatively thin, lightweight sheet-metal molded parts.

In the case of turbine housings constructed from sheet-metal parts and used in exhaust-gas turbochargers, undesired deformations of the sealing contour region, which is likewise composed of sheet metal, can easily occur during operation owing to the above-mentioned demanding usage conditions. Undesired deformations of the sealing contour region of the turbine housing result in a deterioration in thermodynamic efficiency or, in the worst case, result in the turbine wheel, which rotates at high rotational speeds during operation, grinding against the sheet metal in the sealing contour region of the turbine housing.

Such grinding of the turbine wheel against the sheet metal can be prevented by enlarging the contour gap in the radial and axial directions. Such an enlargement of the contour gap however has an adverse effect on the thermodynamic efficiency of the turbine. Furthermore, owing to the production method, the dimensional accuracy of the sealing contour with respect to the turbine wheel can be disadvantageous because the tolerances of the individual sheet-metal parts that are connected to one another may unfavorably add up, which in turn necessitates a structural enlargement of the contour gap for safety reasons and is associated with adverse effects on thermodynamic efficiency. Grinding of the turbine wheel against the sheet metal in the sealing contour region may also be counteracted by virtue of the sheet metal being of correspondingly thick-walled form in said region of the turbine housing. This duly counteracts a deformation of the contour region but in turn increases the production costs of the turbine housing.

Furthermore, to reduce the deformation of the sheet-metal part that forms the sealing contour region, it is already known to produce double-walled turbine housings with sliding seats which absorb the loads that occur. Such an approach also increases the production costs of the turbine housing.

DE 100 22 052 C2 has already disclosed a turbine housing for an exhaust-gas turbocharger. Said turbine housing comprises an inlet funnel, a rotor housing with a gas duct that narrows in spiral form proceeding from the inlet funnel, a flange for connecting to the bearing housing of the exhaust-gas turbocharger, and a central outlet pipe. A turbine wheel rotates in the rotor housing. The spiral-shaped gas duct ends in the region of the inlet funnel at a sealing edge. The inlet funnel, the rotor housing and the outlet pipe are composed of sheet metal deformed in a non-cutting process, for example by stamping or deep-drawing. The rotor housing is composed of two half-shells and is welded to the outlet pipe. The inlet funnel and the rotor housing are surrounded by an additional external housing composed of sheet metal. An air gap is provided between the rotor housing and the additional external housing.

BRIEF SUMMARY OF THE INVENTION

It is thus the object of the invention to specify a turbine housing for an exhaust-gas turbocharger which, with relatively low production costs for the turbine housing, ensures high thermodynamic efficiency of the exhaust-gas turbine.

Said object is achieved by means of a turbine housing having the features specified below. Advantageous embodiments and refinements of the invention are specified in the dependent claims.

The turbine housing according to the invention for an exhaust-gas turbocharger has, inter alia, a bearing housing attachment flange, an exhaust-gas inlet duct, a spiral duct, an exhaust-gas inlet gap, a sealing contour region, and an exhaust-gas outlet connector, and is constructed from multiple interconnected housing parts. Here, the turbine housing is characterized in that a central, unipartite contoured component is provided in the turbine housing on that side of the spiral duct (5) which faces away from the bearing housing attachment flange, which contoured component has a wall region, situated on the side facing away from the bearing housing attachment flange (4*a*), of the spiral duct, a boundary wall, adjoining said wall region, of the exhaust-gas inlet gap, and the sealing contour region adjoining said wall region, wherein the contoured component is formed as a cast component or as a forged component which is connected to the housing parts adjacent thereto, which are formed at least partially as sheet-metal molded parts.

The advantages of the invention consist in particular in that, through application-dependent selection of the geometry, of the material, of the material thickness and/or of the material distribution of the contoured component, the dimensional stability and accuracy of the housing contour can be influenced in targeted fashion, and thus the thermodynamic efficiency of the turbine can be improved in targeted fashion. Nevertheless, the material costs and thus production costs for the turbine housing are kept low, because the further housing parts can, depending on loading and requirements, be designed to be thinner, for example in the form of sheet-metal parts. Accordingly, it is made possible to use a mixture of housing components of relatively thick and relatively thin dimensions as required, without the efficiency of the exhaust-gas turbine being adversely affected.

Further advantages of the invention consist in that, by means of reworking of the component that forms the contour region and of the bearing housing seat of the turbine housing, it is possible after the assembly of the individual housing parts, and in one chucking operation, for the contour region to be pre-manufactured in a precise manner relative to the turbine wheel. This contributes to a further improvement in thermodynamic efficiency.

Furthermore, using the same component, it is possible for different housing contours, which form functional surfaces, such as for example the sealing contour region, a valve seat or a bearing receptacle for a drive linkage of a wastegate flap, to be realized with high accuracy by mechanical reworking of the component. This has the advantage of a considerable reduction in parts costs and in the required variety of parts. Furthermore, it is possible to realize weight savings and material savings.

In one refinement of the turbine housing according to the invention, the contoured component also has an exhaust-gas outlet connector which directly adjoins the sealing contour region in a downstream direction in relation to the exhaust-gas mass stream and which defines an outlet cross section of the turbine. The outlet cross section is, aside from the exhaust-gas inlet gap and the contour gap, a further parameter that influences the thermodynamic efficiency of the turbine. Owing to the integration of the exhaust-gas outlet connector into the dimensionally stable contoured component, it is possible for a precisely defined outlet cross section to be ensured in a simple manner, for example produced during the course of reworking of the further contour and functional surfaces of the contoured component. This likewise contributes to the further improvement in thermodynamic efficiency.

A further embodiment of the turbine housing according to the invention is characterized in that the contoured component also has at least a part of a wall of the exhaust-gas inlet duct which issues into the spiral duct. In other words, at least a part of the exhaust-gas inlet pipe is formed integrally on the contoured component. The exhaust-gas inlet pipe is connected by means of the exhaust-gas inlet flange to the exhaust manifold of an internal combustion engine and thus ensures the positioning of the exhaust-gas turbocharger relative to the internal combustion engine. In this function, at least a part of the mass forces acting on the exhaust-gas turbocharger is transmitted via the exhaust-gas inlet pipe to the internal combustion engine. In other words, said connection constitutes at least a part of the fastening of the exhaust-gas turbocharger to the internal combustion engine, which owing to the weight of the exhaust-gas turbocharger and the vibrations that occur during operation is subject to high mechanical loads. The at least partial implementation of the exhaust-gas inlet pipe as an integral part of the dimensionally stable contoured component configured as a cast component or as a forged component increases the stability and load capacity of the connection between exhaust manifold of the internal combustion engine and the exhaust-gas turbocharger. A further embodiment of the turbine housing according to the invention is characterized in that the contoured component also has a wastegate duct, arranged in the wall region of the spiral duct (5), of a wastegate device, which wastegate duct has a valve flap seat. The precision and dimensional accuracy of the wastegate duct and in particular of the valve flap seat, on which a closed wastegate valve flap sets down sealingly during operation, influence the efficiency of the turbine. The integration of the wastegate duct and of the valve flap seat into the contoured component is conducive to minimizing a leakage flow of exhaust gas, which has an adverse effect on efficiency, when the wastegate valve flap is closed, and thus ensuring high efficiency.

In one refinement of the above-mentioned embodiment of the turbine housing, the contoured component also has a bearing receptacle for a drive linkage of a wastegate valve device. By means of the stated drive linkage, the wastegate valve flap arranged in the turbine housing is actuated, during operation, by an actuator arranged outside the turbine housing. This makes it necessary for the drive linkage to be led through the housing wall, and for the drive linkage to be mounted in the housing wall of the turbine housing. The integration of a bearing receptacle for said drive linkage in the contoured component makes it possible to realize precisely defined positioning of the bearing arrangement and thus of the drive linkage and of the wastegate valve flap fastened thereto, and is thus likewise conducive to minimizing a leakage flow of exhaust gas, which has an adverse effect on efficiency, when the wastegate valve flap is closed and thus ensuring high efficiency. Furthermore, in this way, the production costs for a turbine housing can be kept low, and nevertheless, the dimensional accuracy of the turbine housing can be further improved.

In the case of the embodiment of the turbine housing according to the invention, it has proven to be advantageous for the wall thickness of the contoured component to be greater than the wall thickness of the adjacent housing parts formed as a sheet-metal molded part, in particular has at least twice the wall thickness of the adjacent housing parts formed from sheet-metal molded parts. This ensures an adequately stable embodiment of the contoured component suitable for the preferred production method.

Furthermore, the above-mentioned embodiment of the contoured component permits reworking of the important contour and functional surfaces such as, for example, the sealing contour, the outlet cross section of the turbine, the valve flap seat of the wastegate duct or a bearing receptacle for a drive linkage of the wastegate flap.

In a further embodiment of the turbine housing according to the invention, the contoured component is welded to the housing parts adjacent thereto. This type of connection makes it possible to realize a secure connection, with high load capacity, between the individual housing parts of different material thickness, and is suitable for producing a gas-tight housing shell by means of a materially cohesive connection along the seam lines formed between the individual housing parts.

In a further embodiment, the turbine housing is characterized in that the contoured component forms, with the housing parts adjacent thereto, a single-shell turbine housing. The contoured component imparts the required stability to the single-shell construction and thus permits particularly straightforward construction of the turbine housing through the use of relatively thin-walled housing components in addition to the contoured component.

In a further embodiment, the turbine housing is characterized in that, on the contoured component, a wastegate duct is formed or at least extended by means of adjacent sheet-metal molded parts. Therefore, as an alternative to the above-mentioned embodiment in which the entire wastegate duct, including valve flap seat, is formed integrally with the contoured component, it is provided in this case that not the entire wastegate duct is formed by the contoured component. It is for example possible for only a corresponding opening to be provided in the contoured component, said opening then being adjoined by a wastegate duct formed from a sheet-metal molded part or multiple sheet-metal molded parts that are fastened to the contoured component. This construction permits a further reduction in weight of a turbine housing according to the invention with wastegate device.

In the embodiment of a turbine housing according to the invention, at least one of the following housing parts of the turbine housing is at least partially constructed from sheet-metal molded parts:

- an exhaust-gas inlet pipe, which forms the exhaust-gas inlet duct,
- an exhaust-gas inlet flange which adjoins the exhaust-gas inlet pipe and by means of which the turbine housing is connected to an exhaust pipe of an internal combustion engine,
- an exhaust gas outlet pipe which comprises the exhaust-gas outlet connector and which forms the exhaust-gas outlet duct through which the exhaust gas is conducted, downstream of the exhaust-gas turbine, in the direction of an exhaust system of an internal combustion engine,
- an exhaust-gas outlet flange which adjoins the exhaust-gas outlet pipe and by means of which the connection between exhaust-gas outlet pipe of the turbine housing and an exhaust system of an internal combustion engine can be produced,
- a part, facing toward the bearing housing attachment flange, of the spiral housing that forms the spiral duct, said part being for example in the form of a half-shell element and forming, together with the contoured component, the spiral housing, and
- the bearing housing attachment flange by means of which the turbine housing is connected to a bearing housing of the exhaust-gas turbocharger. Here, said housing parts themselves may in turn be constructed from multiple individual parts which are all or only partially in the form of sheet-metal molded parts. The more of said individual housing parts are formed as thin-walled sheet-metal molded parts, the greater is the weight reduction in relation to conventional turbine housing concepts.

The features of the above-mentioned embodiments of the subject matter of the invention, insofar as they are not usable alternatively or are not mutually exclusive, can partially or entirely also be used in combination or so as to supplement one another.

BRIEF DESCRIPTION OF THE SEVERAL VIEWS OF THE DRAWING

Particularly advantageous exemplary embodiments of the invention will be explained in more detail below on the basis of the figures, although the subject matter of the invention is not restricted to these examples. In the figures.

DESCRIPTION OF THE INVENTION

Components of identical function and designation are denoted by the same reference signs throughout the figures.

Figure 1:
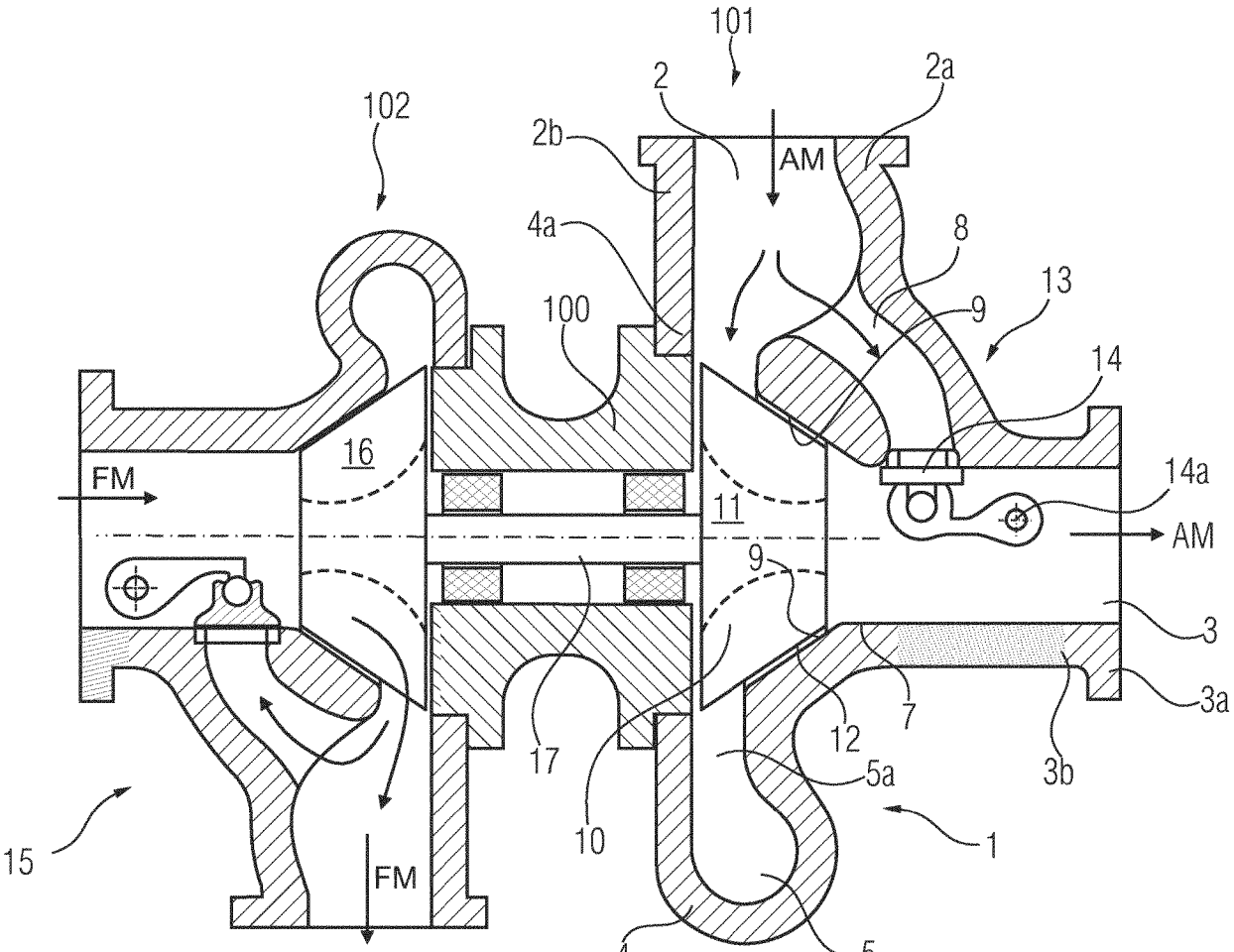
FIG 1 PRIOR ART
FIG. 1 is a simplified sectional illustration of an exhaust-gas turbocharger as per the prior art.

The exhaust-gas turbocharger according to the prior art, as illustrated in FIG. 1, has already been described in the introduction and illustrates the basic construction and the arrangement of the individual components of exhaust-gas turbine 101, fresh-air compressor 102 and bearing housing 100. In particular, said description was given with regard to those components of the exhaust-gas turbocharger which are essential to the invention, specifically the exhaust-gas turbine 101 with turbine housing 1 and the turbine rotor 11, which has a blade arrangement 10.

The illustrated turbine housing 1, conventionally implemented as a cast part, for an exhaust-gas turbocharger has, inter alia, an exhaust-gas inlet duct 2, a spiral duct 5, an exhaust-gas inlet gap 5*a*, a sealing contour region 9 and an exhaust-gas outlet connector 7. The arrangement of the wastegate duct 8 and of the wastegate valve flap 14 with drive linkage 14*a* is also illustrated in FIG. 1.

Figure 2:
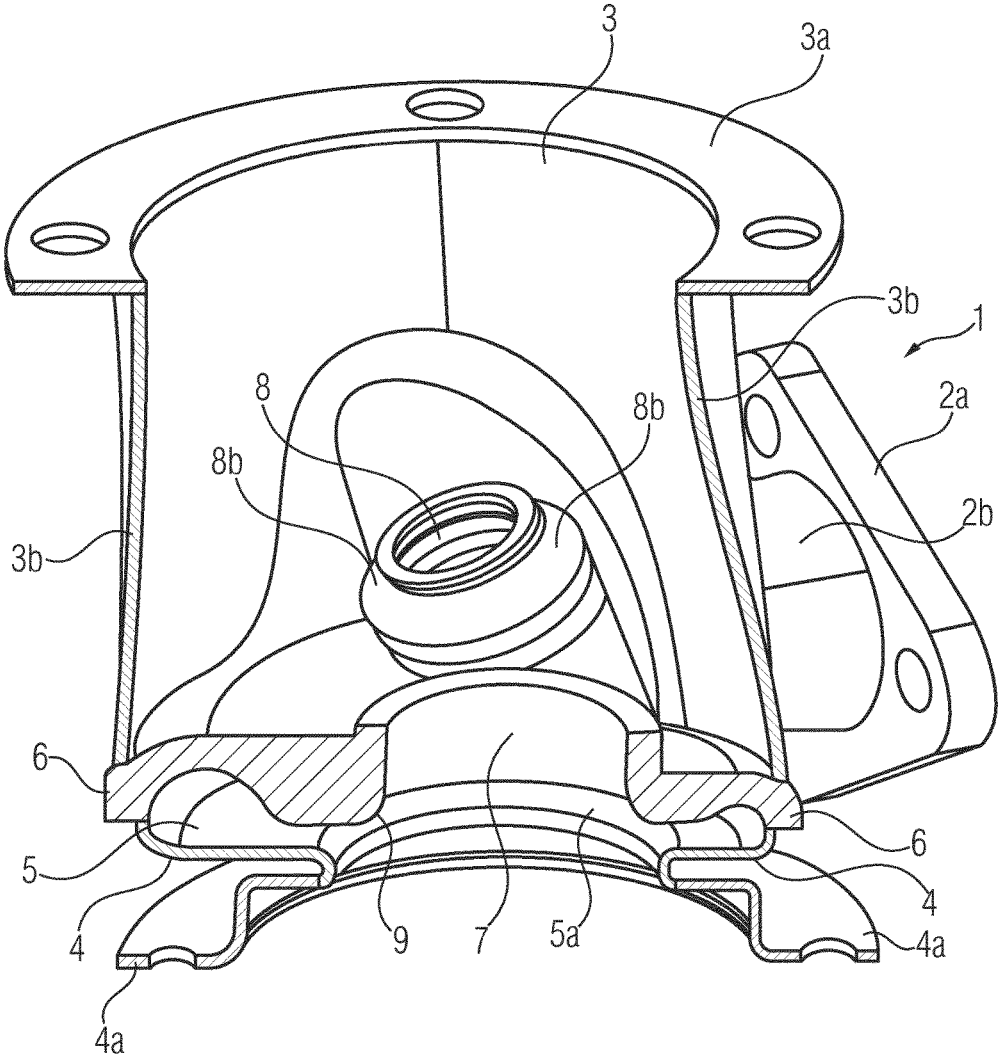
FIG. 2 is a perspective sectional illustration of a turbine housing according to one exemplary embodiment of the invention.

FIG. 2 shows, for a better overview, a turbine housing according to the invention isolated from the other components of the exhaust-gas turbocharger and in a sectional, perspective view. The turbine housing has multiple interconnected housing parts, wherein the contoured component 6 of the turbine housing 1, which has a sealing contour region 9, is in the form of a cast component or forged component which is connected, in particular welded, to the housing parts adjacent thereto, which are in the form of sheet-metal molded parts. The housing parts together with the contoured component 6 form a single-shell housing.

The wall thickness of the contoured component 6 is preferably greater than the wall thickness of the housing parts adjacent thereto. These measures are conducive to increasing the dimensional stability of the turbine housing 1 of an exhaust-gas turbocharger and thus improving the thermodynamic characteristics of the turbine during operation of the exhaust-gas turbocharger. The deformation of the turbine housing 1 that occurs during operation of the exhaust-gas turbocharger, in particular in the region of the sealing contour 9, is reduced in relation to the prior art, wherein at the same time, the production costs for the turbine housing 1 and the weight of said turbine housing are kept low. Furthermore, good dimensional accuracy is ensured through reworking of the important contour and functional surfaces of the sealing contour, of the outlet cross section of the turbine and of the valve flap seat of the wastegate duct. The illustrated turbine housing 1 has an exhaust-gas inlet flange 2*a* for example for attachment to an exhaust manifold of an internal combustion engine, an exhaust-gas outlet flange 3*a* for attachment to an exhaust system of an internal combustion engine, and a bearing housing attachment flange 4*a* for attachment of the turbine housing 1 to the bearing housing 100 of an exhaust-gas turbocharger. The bearing housing attachment flange 4*a* and the exhaust-gas outlet flange 3*a* are implemented as sheet-metal molded parts, by contrast to the exhaust-gas inlet flange 2*a*, which is implemented as a massive cast or forged molded part or molded part produced by cutting processes. Furthermore, FIG. 2 shows a spiral housing part 4, formed as a sheet-metal molded part, on that side of the spiral housing which faces toward the bearing housing attachment flange 4*a*, and a contoured component 6, implemented according to the invention as a massive cast or forged part, on that side of the spiral housing which faces away from the bearing housing attachment flange 4*a*, wherein the spiral housing is in each case formed half by the spiral housing part 4 and half by the contoured component 6 implemented as a massive cast or forged part. The two housing parts of the spiral housing, which each form a half-shell of the spiral housing, are for example welded to one another in gas-tight fashion along their contact line with a continuous weld seam. Furthermore, the turbine housing 1 shown in FIG. 2 has a wastegate duct 8 realized by means of wastegate housing parts 8*b* which are in the form of sheet-metal molded parts and which are fastened, preferably welded, to the contoured component 6 and welded to one another. Arranged between the contoured component 6 and the exhaust-gas outlet flange 3*a* is the exhaust-gas outlet pipe 3*b* which, in this example, is assembled from at least two sheet-metal molded parts. The exhaust-gas outlet pipe 3*b* is seated on a shoulder in the outer region of the contoured component 6 and is connected in gas-tight fashion, for example welded, to the contoured component 6 continuously along the contact line over the entire circumference. At the opposite end of the exhaust-gas outlet pipe 3*b*, the exhaust-gas outlet flange 3*a* is likewise connected in gas-tight fashion, for example welded, to the exhaust-gas outlet pipe 3*b* continuously along the contact line over the entire circumference.

Arranged between the exhaust-gas inlet flange 2*a* and the contoured component 6 is the exhaust-gas inlet pipe 2*b*. The exhaust-gas inlet pipe 2*b* is likewise assembled from at least two shell-shaped sheet-metal molded parts and is connected in gas-tight fashion, for example by weld seams, to the exhaust-gas outlet flange 2*a* at one side and to the contoured component 6 at the other side. Furthermore, the turbine housing 1 shown in FIG. 2 has a wastegate duct 8 which is formed by wastegate housing parts 8*b* which are fastened, preferably welded, to the contoured component 6 and welded to one another and which are in the form of sheet-metal molded parts.

The contoured component 6, which forms the stabilizing core of the turbine housing 1 has, in addition to the contour for the spiral duct 5, a wall, joining said contour, of the exhaust-gas inlet gap 5*a*, and adjoining said wall in turn, a sealing contour region 9 which merges into the exhaust-gas outlet connector 7. Both the exhaust-gas inlet gap 5*a* and the sealing contour region 9 which defines the contour gap 12 (see FIG. 1), and also the diameter of the exhaust-gas outlet connector 7 have a significant influence on the flow characteristics and thermodynamic efficiency of the turbine housing. The contour gap 12 corresponds to the distance of the sealing contour from the outer contour of the blade arrangement 10 of the turbine wheel 11 that rotates during operation of the exhaust-gas turbocharger. Said distance must, during operation of the exhaust-gas turbocharger, be maintained as precisely as possible at all operating points, in order firstly to prevent the turbine wheel from grinding against the turbine housing and secondly to prevent the distance of the sealing contour 9 from the turbine wheel, and thus the contour gap, becoming too large as a result of a deformation of the turbine housing, which would result in an undesired deterioration of the thermodynamic characteristics of the turbine.

To prevent such undesired deformation of the turbine housing 1 during operation of the exhaust-gas turbocharger, it is the case in a turbine housing according to the invention that the contoured component 6 that forms the sealing contour region 9 of the turbine housing 1 is in the form of a cast component or forged component which is for example welded to the housing components adjacent thereto and, together with these, forms a single-shell turbine housing. To keep the weight of the turbine housing and thus of the exhaust-gas turbocharger as a whole as low as possible, the housing parts adjacent to the contoured component 6 are implemented in the form of sheet-metal parts. In the case of this exemplary embodiment, it is preferable for all of the components of the turbine housing with the exception of the contoured component 6 and the exhaust-gas inlet flange 2*a* to be implemented in the form of sheet-metal molded parts, whereas the contoured component 6 is—as already discussed above—in the form of a cast component or forged component. All of the contour and dimension ranges of significance with regard to function and efficiency, as already mentioned above, are thus defined by the contoured component and can be produced inexpensively, and ensured in stable fashion over the entire operating range of the exhaust-gas turbocharger, through high-position machining of only this single component.

As material for the contoured component 6, use is preferably made of a high temperature-resistant material, for example a compacted graphite iron material, an E5S material, cast steel or a forged steel part.

The wall thickness of the contoured component 6 is preferably greater than the wall thickness of the housing parts adjacent thereto which are in the form of sheet-metal molded parts; in particular, the contoured component has at least twice the wall thickness. These measures are conducive to ensuring the dimensional stability of the turbine housing 1 of an exhaust-gas turbocharger and thus improving the thermodynamic efficiency of the turbine during operation of the exhaust-gas turbocharger. The deformations of the turbine housing that occur during the operation of the exhaust-gas turbocharger, in particular in the region of the sealing contour of the contoured component, are reduced in relation to the prior art, wherein at the same time, the production costs for the turbine housing 1, and the weight thereof, are kept low.

The first exemplary embodiment, as shown in FIG. 2, thus involves a single-shell turbine housing 1, in which the exhaust-gas inlet pipe 2*b*, the exhaust-gas outlet flange 3*a* and the exhaust-gas outlet pipe 3*b*, the bearing housing attachment flange 4*a* and the spiral housing part 4, and the wastegate housing part 8*b* are in the form of sheet-metal molded parts, whereas the exhaust-gas inlet flange 2*a* and in particular the contoured component 6 are formed as a massive cast component or as a forged component.

Figure 3:
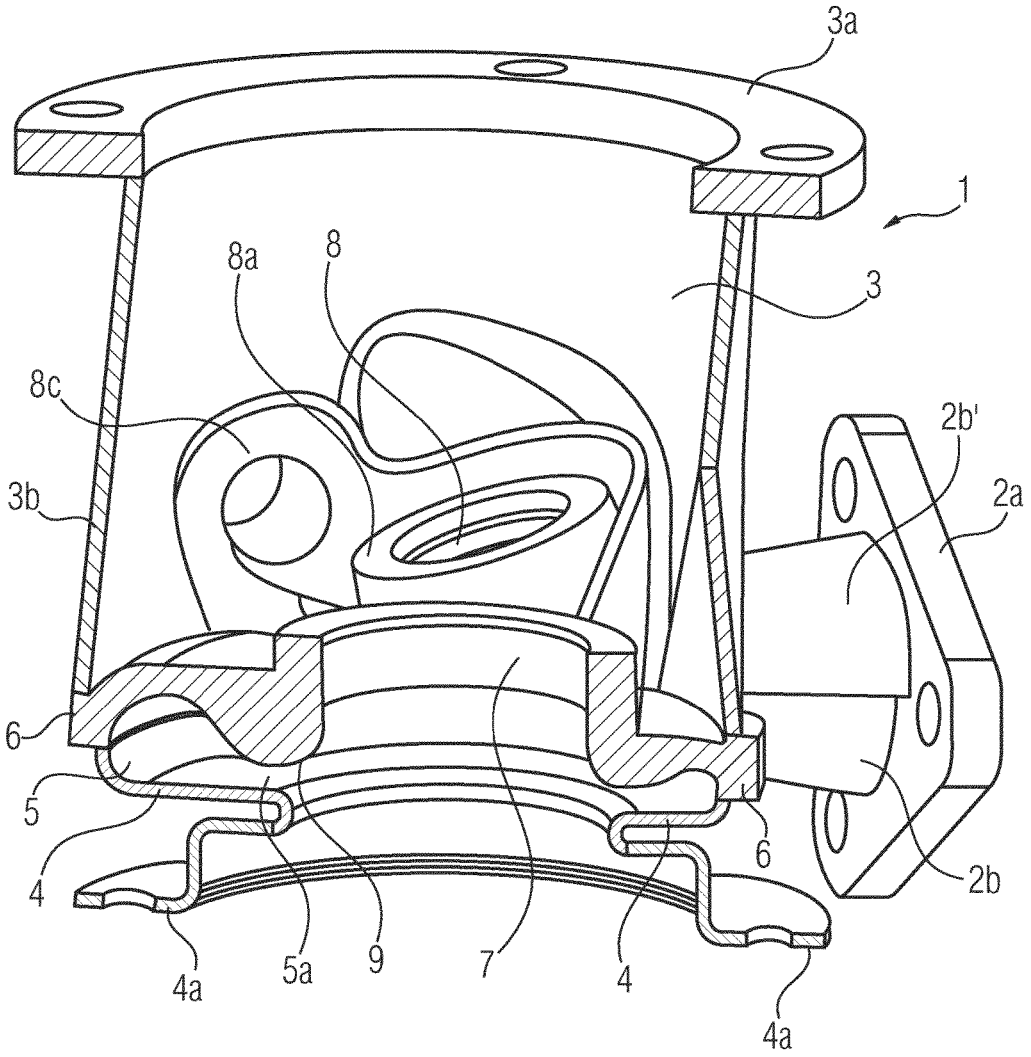
FIG. 3 is a perspective sectional illustration of a turbine housing according to a further exemplary embodiment of the invention.

FIG. 3 shows, in a diagrammatic sketch, a sectional illustration of a turbine housing according to the invention as per a further exemplary embodiment. Major parts of the turbine housing 1 illustrated in FIG. 3 correspond to the exemplary embodiment from FIG. 2, which parts will not be described again here.

In this further exemplary embodiment, too, the contoured component 6, which forms the stable core of the turbine housing 1 and in particular defines the exhaust-gas inlet gap 5*a* and the sealing contour 9, is formed as a cast component or as a forged component which is connected, preferably welded, to the further housing parts adjacent thereto, which are in the form of sheet-metal molded parts.

This further exemplary embodiment differs from the first exemplary embodiment shown in FIG. 2 substantially in that a wastegate duct 8, including a valve flap seat 8*a* and also a bearing receptacle 8*c* for a drive linkage 14*a* of a wastegate valve flap 14 is integrated in unipartite fashion into the contoured component 6, which is in the form of a cast or forged component. As a further difference, it is also the case in FIG. 3 that the exhaust-gas inlet pipe is at least partially integrated in unipartite fashion into the contoured component 6. For example, the upper part 2*b'* illustrated in FIG. 3 is formed as an integral constituent part of the contoured component 6, whereas the lower part of the exhaust-gas inlet pipe 2*b* in FIG. 3 is in the form of a sheet-metal molded part with a smaller wall thickness and is connected, for example welded, to the upper part 2*b*'. Also, the exhaust-gas outlet flange 3*a* is, in this embodiment of the turbine housing, formed as a massive cast component or forged component or component produced by cutting processes.

In the case of a turbine housing as per the further exemplary embodiment, the degree of integration of functionally important contours, surfaces, dimensions and components is increased further in relation to the first exemplary embodiment. In this way, production costs can be further reduced, the dimensional accuracy of the turbine housing can be further improved, and thus efficiency and functional reliability can be further improved.

The invention claimed is:

1. A turbine housing for an exhaust-gas turbocharger, the turbine housing comprising:

a plurality of interconnected housing parts including:

a bearing housing attachment flange;

an exhaust-gas inlet duct receiving exhaust gas;

a spiral duct receiving the exhaust gas from said exhaust-gas inlet duct and having a side facing away from said bearing housing attachment flange;

an exhaust-gas inlet gap associated with said spiral duct; and an exhaust-gas outlet connector associated with said exhaust-gas inlet gap;

at least some of said plurality of interconnected housing parts being formed as sheet-metal molded parts; and a central, one-part contoured component disposed on said side of said spiral duct facing away from said bearing housing attachment flange;

said contoured component having a wall region disposed on said side of said spiral duct facing away from said bearing housing attachment flange, a boundary wall of said exhaust-gas inlet gap adjoining said wall region, and a sealing contour region adjoining said wall region;

said contoured component being a cast component or a forged component connected to said plurality of interconnected housing parts at least some of which being formed as sheet-metal molded parts and disposed adjacent said contoured component; and said cast or forged component connected to said bearing housing attachment flange solely by said spiral duct.

2. The turbine housing according to claim 1, wherein said exhaust-gas outlet connector directly adjoins said sealing contour region.

3. The turbine housing according to claim 1, wherein said contoured component forms at least a part of a wall of said exhaust-gas inlet duct issuing into said spiral duct.

4. The turbine housing according to claim 1, wherein said contoured component has a wastegate duct, and said wastegate duct has a valve flap seat.

5. The turbine housing according to claim 4, which further comprises a wastegate valve device having a drive linkage, said contoured component having a bearing receptacle for said drive linkage.

6. The turbine housing according to claim 1, wherein:

said plurality of interconnected housing parts that are disposed adjacent said contoured component include at least some components that are formed as sheet-metal molded parts and have a wall thickness; and said contoured component has a wall thickness that is greater than said wall thickness of said plurality of interconnected housing parts that are disposed adjacent said contoured component.

7. The turbine housing according to claim 6, wherein said wall thickness of said contoured component is at least twice as great as said wall thickness of said plurality of interconnected housing parts that are disposed adjacent said contoured component.

8. The turbine housing according to claim 6, wherein said contoured component has reworked contour and functional surfaces.

9. The turbine housing according to claim 1, wherein said contoured component is welded to said adjacent housing parts at least some of which are formed as sheet-metal molded parts.

10. The turbine housing according to claim 1, wherein said contoured component forms a single-shell turbine housing with said plurality of interconnected housing parts that are disposed adjacent said contoured component.

11. The turbine housing according to claim 1, which further comprises a wastegate duct formed on said contoured component.

12. The turbine housing according to claim 11, which further comprises sheet-metal molded parts disposed adjacent said contoured component and extending said wastegate duct.

13. The turbine housing according to claim 1, wherein said plurality of interconnected housing parts at least some of which are formed as sheet-metal molded parts include at least one of:

an exhaust-gas inlet pipe, an exhaust-gas inlet flange, an exhaust-gas outlet pipe, an exhaust-gas outlet flange, a part of a spiral housing facing toward said bearing housing attachment flange and forming said spiral duct, and said bearing housing attachment flange.

14. The turbine housing according to claim 1, wherein said plurality of interconnected housing parts includes an exhaust-gas inlet flange being a cast component or a forged component.

* * * * *